US007946097B2

(12) United States Patent
Gnann et al.

(10) Patent No.: US 7,946,097 B2
(45) Date of Patent: May 24, 2011

(54) FEEDER

(75) Inventors: Kurt Gnann, Biberach (DE); Juergen Liebhardt, Laupheim (DE); Martin Zuleger, Achstetten (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 109 days.

(21) Appl. No.: 12/424,291

(22) Filed: Apr. 15, 2009

(65) Prior Publication Data

US 2009/0265034 A1 Oct. 22, 2009

(30) Foreign Application Priority Data

Apr. 16, 2008 (EP) ..... 08007419

(51) Int. Cl.
*B65B 5/04* (2006.01)

(52) U.S. Cl. ..... 53/246; 53/237; 53/539

(58) Field of Classification Search ..... 53/246, 53/237, 240, 559, 539

See application file for complete search history.

(56) References Cited

U.S. PATENT DOCUMENTS 5,799,468 A * 9/1998 Eck et al. ..... 53/453
5,842,573 A * 12/1998 Halvorsen ..... 206/569
6,494,022 B1 * 12/2002 Aylward ..... 53/473
6,732,486 B2 * 5/2004 Saint-Ramon et al. ..... 53/131.4
7,104,035 B2 * 9/2006 Hahnel ..... 53/561
7,213,809 B2 * 5/2007 Vedoy et al. ..... 271/296
7,225,597 B1 * 6/2007 Knoth ..... 53/246
7,426,814 B2 * 9/2008 Knoth ..... 53/473
7,565,781 B2 * 7/2009 Krahl et al. ..... 53/158
7,587,878 B2 * 9/2009 Kim ..... 53/246
2007/0271882 A1 11/2007 Litke et al.

FOREIGN PATENT DOCUMENTS

EP 0224017 A1 6/1987
WO WO 2007/132697 A1 11/2007

* cited by examiner

*Primary Examiner* — Sameh H. Tawfik
(74) *Attorney, Agent, or Firm* — Brinks Hofer Gilson & Lione

(57) ABSTRACT

The feeder for the controlled transfer of product items into the pockets of a web of sheeting has a base unit, a supply container for holding the product items, and a product conveyor for receiving the product items from the supply container. Further, the feeder has an exchangeable format unit including a sorting plate for receiving the product items from the product conveyor, a filling unit with a number of vertically extending filling tubes for receiving the product items from the sorting plate and with a blocking slide unit with a blocking slide plate for temporarily blocking the guiding channels of the filling tubes. The format unit further has a filling shoe for receiving the product items from the filling unit and for guiding them to the pockets of the web of sheeting. A plurality of drives and the corresponding electrical control components for moving the format unit, the sorting plate, the blocking slide plate and the filling shoe are arranged in the base unit.

4 Claims, 6 Drawing Sheets

FEEDER

CROSS-REFERENCE TO RELATED APPLICATIONS

This application claims the benefit of European Patent Application No. EP 08 007 419.8 filed on Apr. 16, 2008, entitled "FEEDER" the entire contents of which are incorporated herein by reference.

FIELD OF THE INVENTION

The present invention pertains to a feeder for a controlled transfer of tablets, capsules, dragées or the like into the pockets of continuously or cyclically conveyed web of sheeting with electronic control components and a base unit for this feeder.

In such feeder, the electrical control components are conventionally arranged outside the feeder. The feeder comprises a supply container, which holds the bulk material, from which the tablets can be transferred via a product conveyor to a sorting plate comprising a first drive. From there the tablets are transferred into the filling tubes of a filling unit with a blocking slide unit, which serves to individuate and to sort the tablets, and which comprises a second drive. In addition, a filling shoe is required, which can be lowered by way of a third drive to deposit the tablets onto the web of sheeting. The electrical control components are necessary to control these drives, wherein it must be remembered that, because of tablet breakage and/or tablet abrasion, it is possible for large amounts of dust to contaminate the feeder, and that the electrical control components are sensitive to dust, which is why, in the case of the conventional feeder, the electrical control components are installed externally in a control panel. The feeder is set up on a machine table of the thermoforming machine, wherein the control panel with the electrical control components is provided at an appropriate distance from the thermoforming machine.

This arrangement suffers from the disadvantage that the electrical lines must be laid individually into the control panel, because only there the motor and the sensors can be connected to the control unit. The electrical lines lead to the filling section, where they can become contaminated with tablet dust, as a result of which a large amount of cleaning work is required. In addition, the control panel takes up additional space next to the thermoforming machine and can under certain conditions block access to more convenient operation of the thermoforming machine.

SUMMARY OF THE INVENTION

It is an object of the present invention to provide a feeder for a controlled transfer of products into the pockets of a continuously or cyclically conveyed web of sheeting, which overcomes the disadvantages cited above.

The feeder for the controlled transfer of product items into pockets of a continuously or cyclically conveyed web of sheeting comprises:

- a base unit;
- a supply container for holding the product items;
- a product conveyor for receiving the product items from the supply container;
- a format unit attached to the base unit and comprising:
  - a sorting plate for receiving the product items from the product conveyor;

- a filling unit comprising:
  - a number of vertically extending filling tubes, each of them having a guiding channel for receiving the product items from the sorting plate, and
  - a blocking slide unit with a blocking slide plate for temporarily blocking the guiding channels of the filling tubes; and
  - a filling shoe for receiving the product items from the filling unit and for guiding them to the pockets of the web of sheeting; and
  - a plurality of drives and corresponding electrical control components for moving at least two of the format unit, the sorting plate, the blocking slide plate, and the filling shoe, wherein the plurality of drives and corresponding electrical control components are arranged in the base unit.

Thus, all electrical control components of the drives are arranged in an enclosed, dustproof area in the base unit. As a result, a space-saving design is achieved without impairment to the reliability of the electrical components. This also makes it possible to clean the filling section more quickly. An additional advantage is that the servo cables are less susceptible to malfunction, because they do not have any intermediate plug connections.

Preferably, all electrical control components are arranged in an integrated control panel in the base unit. One wall of the integrated control panel is preferably designed as a wall of the base unit, especially as a rear wall of the base unit. This leads to the advantage of a further decrease in the amount of space required and of an especially sturdy construction.

It has been found favorable for the integrated control panel to be installed pivotably in the base unit, so that the integrated control panel can serve as a door of the base unit for opening and closing a second access area for mechanical maintenance in the base unit. As a result, mechanical maintenance work on the base unit can be carried out easily.

In an advantageous exemplary embodiment of the feeder, the integrated control panel comprises an additional control panel door for opening and closing a first access area for electrical maintenance with a first locking device, and a second locking device is used for the door of the base unit, wherein the first and the second locking devices are designed to work with different keys. This offers the advantage that the access areas for electrical and mechanical maintenance can be handled in a manner which automatically separates them from each other.

According to another aspect of the feeder, it is has been found advantageous for a coolant circuit to be provided in the integrated control panel and for a coolant connector to be arranged preferably in the control panel door on the outside surface of the control panel. In this way, the waste heat can be dissipated more effectively, and the reliability and the service life of the electrical control unit can be increased. Because of the dustproof enclosure of the integrated control panel versus the base unit, which is subject to contamination with tablet dust, the electrical control unit can be cooled additionally by fans in an air recirculation process to transport the waste heat to the coolant circuit.

Control units for the drives, furthermore, can be arranged in the integrated control panel of the feeder, and drives, especially an electrical drive for the feeder, can be arranged in the base unit in such a way that the drives for the feeder are stationary. This offers the advantage that the electrical lines are not subjected to cyclical loads, which has the effect of prolonging their service life. An additional advantage is that the motors do not have to be moved along as well, so that less energy is consumed during operation. In addition, the mechanical components can be smaller, because the components which do have to be moved are lighter in weight.

BRIEF DESCRIPTION OF THE DRAWINGS

The invention is explained in greater detail in the following on the basis of the exemplary embodiments illustrated in the drawings.

DETAILED DESCRIPTION OF SPECIFIC EMBODIMENTS

Figure 1A:
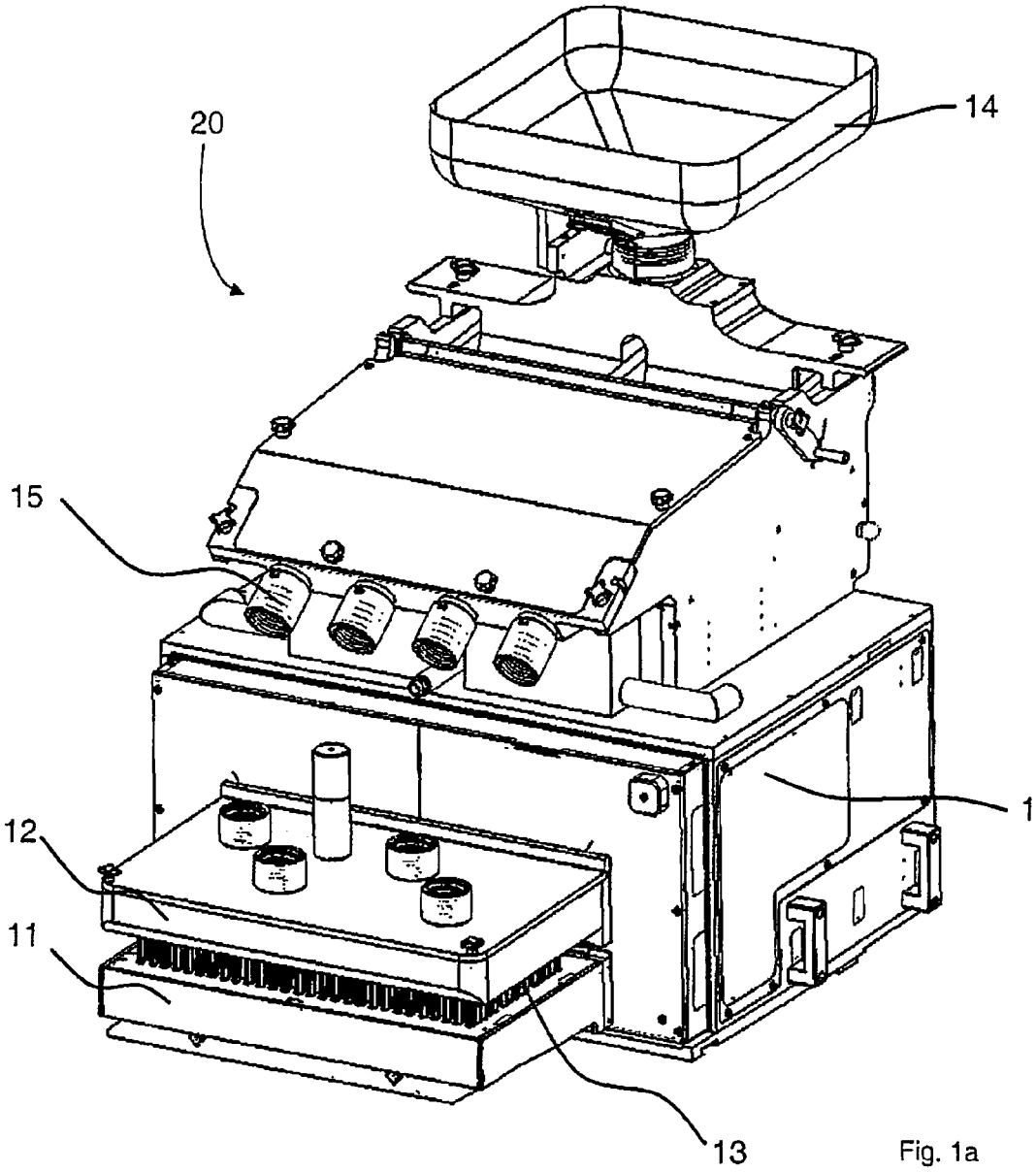
FIG. 1*a* is a perspective view of a feeder with base unit and blocking slide unit.
Figure 1B:
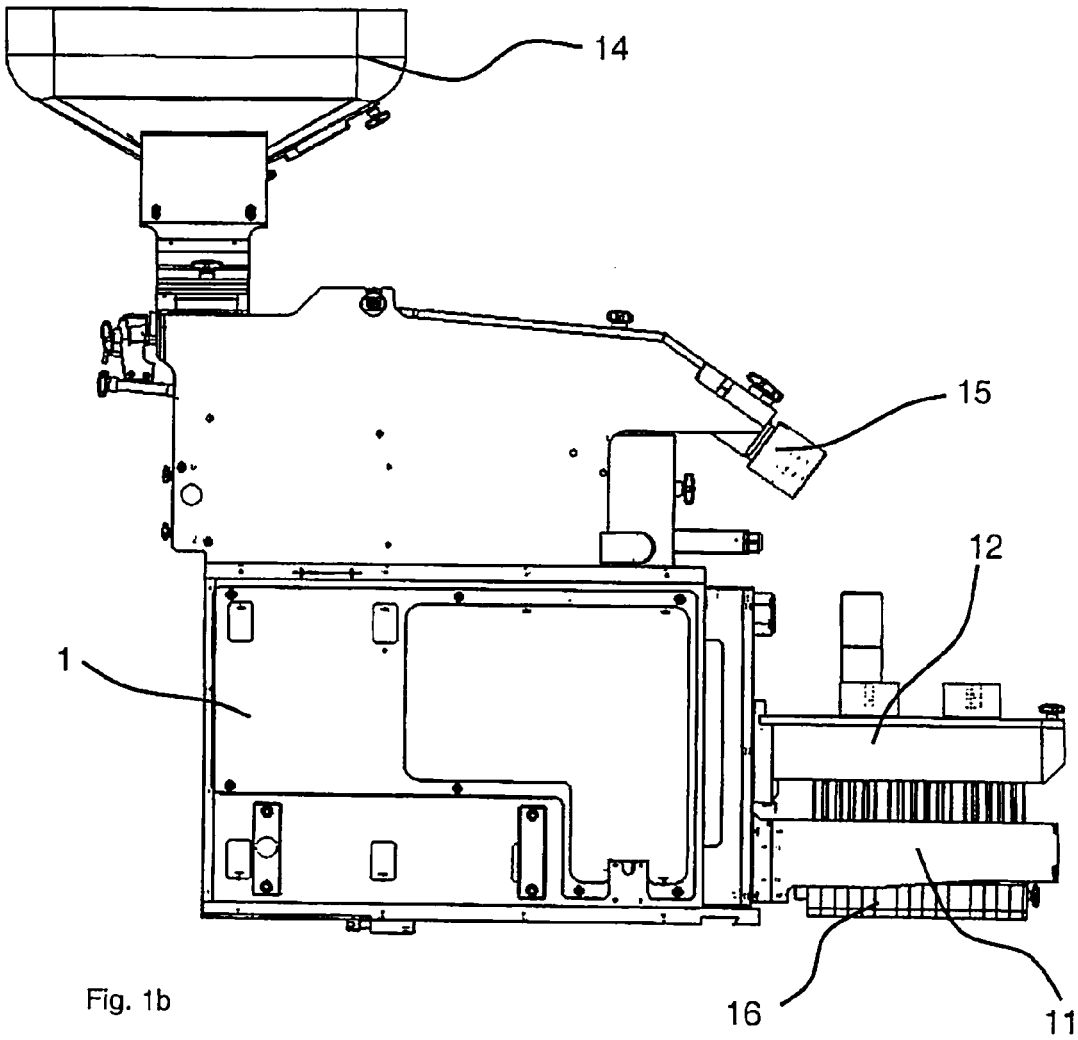
FIG. 1*b* is a side view of the feeder of FIG. 1.

FIG. 1*a* is a perspective view of a feeder 20 with a base unit 1 and a format unit, which is exchangeably attached to the base unit 1. FIG. 1*b* is a side view of the feeder 20. The feeder 20 is used to transfer tablets, capsules, dragées or the like in a controlled manner into the pockets of a continuously or cyclically conveyed web of sheeting.

The feeder 20 comprises a supply container 14, a product conveyor 15, and the format unit. The format unit can be exchanged depending on the size and shape of products to be filled, and comprises a sorting plate 12 (which is covered in FIGS. 1*a* and 1*b* and can thus not be seen in detail), a filling unit including filling tubes 13 and a blocking slide unit 11, and a filling shoe 16.

The tablets are transferred from the supply container 14 via the product conveyor 15 to the sorting plate 12. By means of a first drive, the sorting plate 12 is moved in such a way (for example, upward and downward, but also vibratory movements can be suitable) that the tablets are sorted into the filling tubes 13 of the filling unit. The filling tubes 13 are designed to provide a proper orientation of the tablets. The tablets, which are arranged in a stack in the filling tubes 13, must further be singled out so that only individual tablets are fed to the filling shoe 16 and from there to the pockets of the web of sheeting, preferably a blister package, conveyed below the filling shoe 16. This separation process of single tablets in the filling tubes 13 is performed by at least one blocking slide plate (which is also covered and can thus not be seen) of the blocking slide unit 11 having horizontally extending blocking fingers which are moved out of and back into the guiding channel of the filling tubes 13. In this way, the blocking slide plate blocks the guiding channels in its inserted position, while it allows exactly one tablet per filling tube 13 to fall down in its removed position. The blocking slide plate is moved in a horizontal direction by a second drive, such as a pneumatic cylinder, in such a way that the tablets are individuated, sorted, and transferred into the filling shoe 16.

The whole format unit, which comprises the sorting plate 12, the filling unit and the filling shoe 16, can be synchronized by a third drive to the translational speed of the conveyed web of sheeting in order to be able to deposit the tablets into the web of sheeting. Furthermore, the whole format unit or the filling shoe 16 may be lowered by a fourth drive in order to facilitate the proper filling of the pockets of the web of sheeting. Some of the drives mentioned above could also be omitted or varied. In any way, the plurality of drives is arranged in the base unit 1 and can be controlled completely or partially by electrical control components which are also arranged in the base unit 1. Preferably, the electrical control components are arranged in an integrated control panel 2 arranged in the base unit 1.

Figure 2:
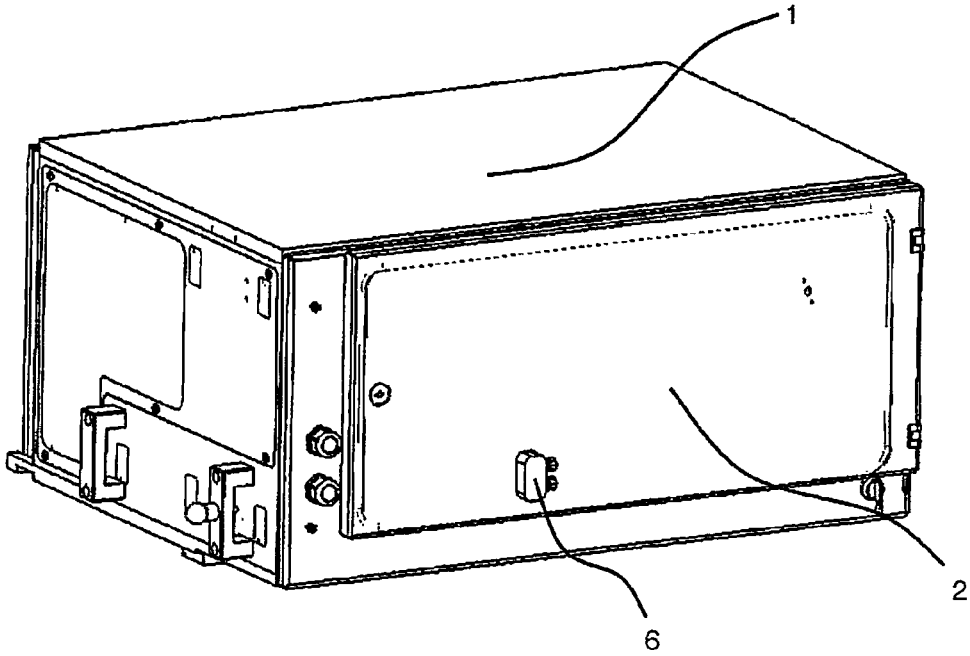
FIG. 2 is a perspective view of the base unit with an integrated control panel in a completely closed state.

FIG. 2 shows an example of an integrated control panel 2 arranged in the base unit 1. One wall of the integrated control panel 2 is designed as a wall, preferably a rear wall, of the base unit 1. Because the space in the integrated control panel 2 for the feeder 20 of a thermoforming machine is very cramped, and because it advantageous to reduce the number of electrical lines in the filling section, the integrated control panel 2 is integrated completely into the base unit 1.

Figure 3:
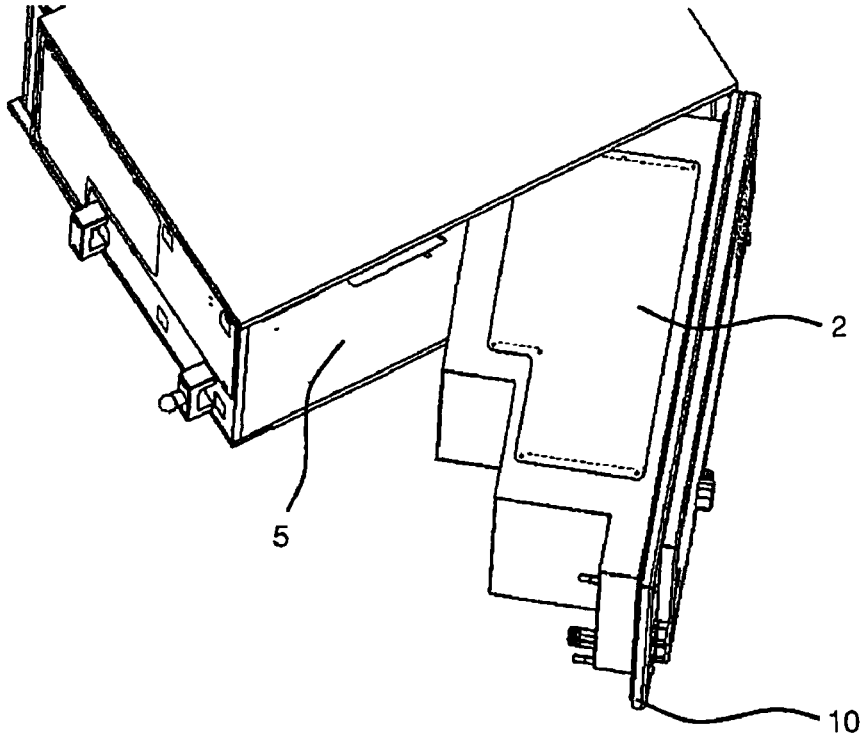
FIG. 3 is a perspective view of the base unit with the integrated control panel according to FIG. 2, in which a first access area for mechanical maintenance has been opened.

FIG. 3 shows the base unit 1 with integrated control panel 2, in which a second access area 5 for mechanical maintenance in the base unit 1 has been opened. The integrated control panel 2 is arranged so that it can pivot in the base unit 1 in such a way that the integrated control panel 2 serves as a rear door 10 for the base unit 1 for opening and closing a second access area 5 for mechanical maintenance work. For any necessary maintenance work on the mechanical components, the integrated control panel 2, together with the electrical components, can be pivoted out to open the second access area 5, wherein this second access area 5 can be opened without touching the electrical components. Thus it is possible for a mechanic to perform mechanical maintenance work without the help of an electrician.

Figure 4:
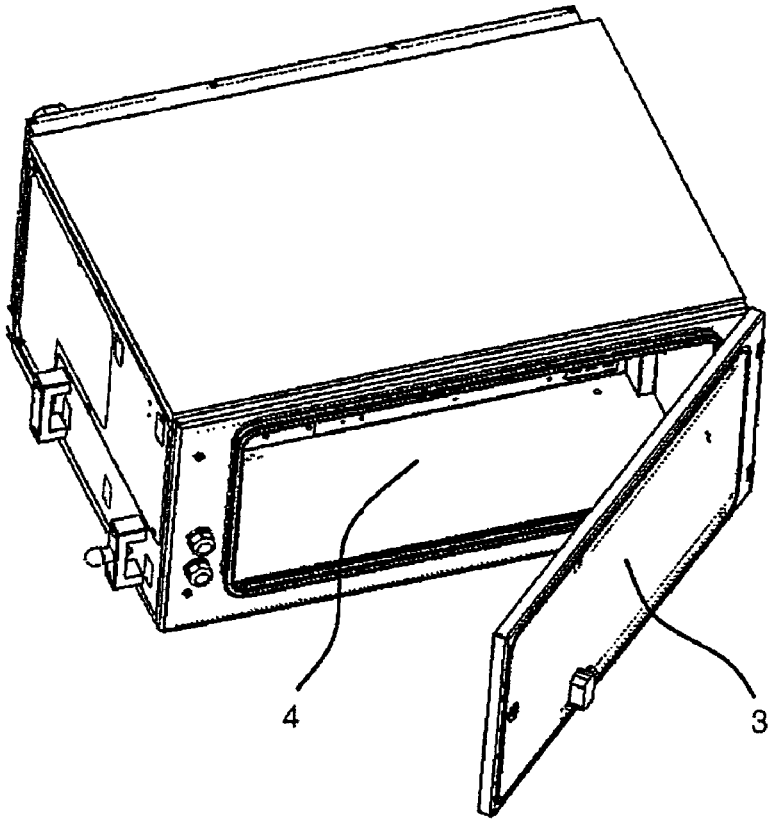
FIG. 4 is a perspective view of the base unit with the integrated control panel according to FIG. 2, in which a second access area for electrical maintenance has been opened.

FIG. 4 shows the integrated control panel 2 in an opened state, in which an additional control panel door 3 has been swung out, thus releasing a first access area 4 for electrical maintenance work. This control panel door 3 corresponds to a conventional control panel door, which can be opened only by the use of a special key so that electrical maintenance work can be performed. Therefore, a first locking device for the control panel door 3 and a second locking device for the door 10 of the base unit are designed to work with different keys.

FIG. 2 shows that the integrated control panel 2 can comprise a coolant connector 6 for a coolant circuit on the control panel door 3. The coolant circuit is designed, for example, as a cooling plate in the control panel door 3, so that the waste heat can be carried away easily from the integrated control panel 2.

Figure 5:
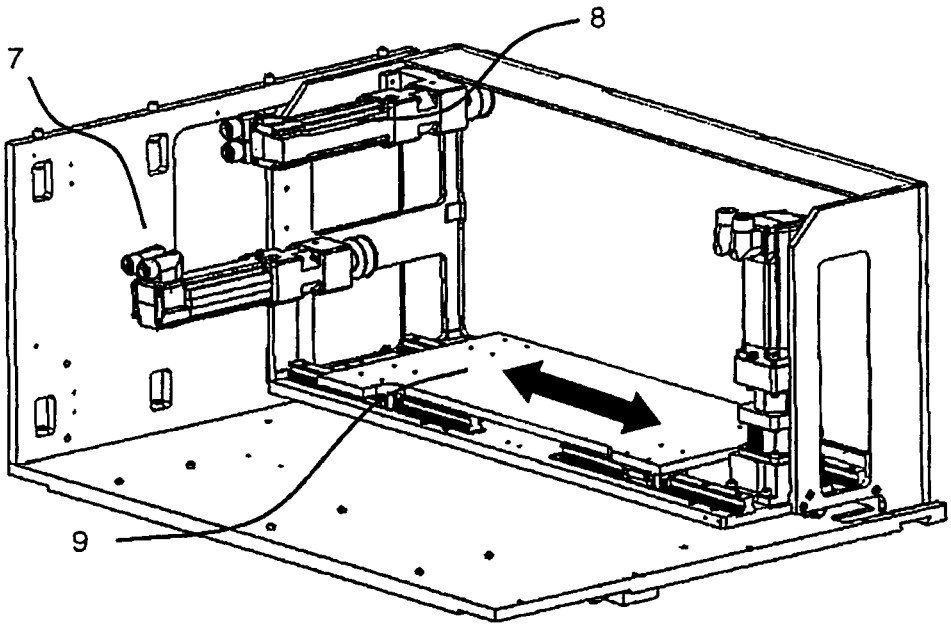
FIG. 5 is a schematic perspective view of an arrangement of electrical drives and a slide in the base unit.

FIG. 5 shows an arrangement of three of the plurality of electrical drives 8 described above in the base unit 1. A slide 9 serves for synchronization of the horizontal speed of the filling shoe 16 with the translational speed of the web of sheeting. The slide 9 for synchronization and the electrical drives 8 for the feeder are arranged in such a way that the drives 8 are stationary. The external housing of the base unit 1 with the housing walls 7 is also stationary, so that the electrical drives 8 remain stationary in the travel direction of the web of sheeting.

The invention claimed is:

1. A feeder for the controlled transfer of product items into pockets of a continuously or cyclically conveyed web of sheeting, wherein the feeder comprises:

a base unit;

a supply container for holding the product items;

a product conveyor for receiving the product items from the supply container;

a format unit attached to the base unit and comprising:

a sorting plate for receiving the product items from the product conveyor;

a filling unit comprising:

a number of vertically extending filling tubes, each of them having a guiding channel for receiving the product items from the sorting plate, and a blocking slide unit with a blocking slide plate for temporarily blocking the guiding channels of the filling tubes; and a filling shoe for receiving the product items from the filling unit and for guiding them to the pockets of the web of sheeting; and a plurality of drives and corresponding electrical control components for moving at least two of the format unit, the sorting plate, the blocking slide plate, and the filling shoe, wherein the plurality of drives and corresponding electrical control components are arranged in the base unit, the electrical control components being arranged in an integrated control panel in the base unit;

wherein one wall of the integrated control panel forms a wall of the base unit, and the integrated control panel is installed pivotably in the base unit in such a way that the integrated control panel serves as a door of the base unit for opening and closing a second access area in the base unit, and wherein the integrated control panel has a control panel door for opening and closing a first access area.

2. The feeder according to claim 1, wherein one wall of the integrated control panel forms a rear wall of the base unit.

3. The feeder according to claim 2, wherein the integrated control panel is installed pivotably in the base unit in such a way that the integrated control panel serves as a rear door of the base unit for opening and closing a the second access area in the base unit.

4. The feeder according to claim 1, wherein the door of the base unit is lockable by a first locking device, and the control panel door is lockable by a second locking device, the first and the second locking devices being designed differently.

* * * * *